US005957786A

United States Patent [19]

Aoyama

[11] Patent Number: 5,957,786

[45] Date of Patent: Sep. 28, 1999

[54] GOLF BALL DIMPLE PATTERN

[75] Inventor: Steven Aoyama, Marion, Mass.

[73] Assignee: Acushnet Company, Fairhaven, Mass.

[21] Appl. No.: 08/922,633

[22] Filed: Sep. 3, 1997

[51] Int. Cl.[6] ..... A63B 37/14

[52] U.S. Cl. ..... 473/379; 473/382; 473/384

[58] Field of Search ..... 473/379, 382, 473/383, 384

[56] References Cited

U.S. PATENT DOCUMENTS

| | | | |
|---|---|---|---|
| D. 318,507 | 7/1991 | Gobush et al. | D21/205 |
| D. 318,508 | 7/1991 | Gobush et al. | D21/205 |
| D. 320,828 | 10/1991 | Gobush et al. | D21/205 |
| D. 320,829 | 10/1991 | Gobush et al. | D21/205 |
| D. 321,231 | 10/1991 | Gobush et al. | D21/205 |
| D. 327,519 | 6/1992 | Gobush et al. | D21/205 |
| D. 336,755 | 6/1993 | Pelletier | D21/205 |
| D. 340,488 | 10/1993 | Aoyama | D21/205 |
| D. 349,141 | 7/1994 | Pelletier et al. | D21/205 |
| D. 359,993 | 7/1995 | Pelletier et al. | D21/205 |
| D. 364,904 | 12/1995 | Pelletier et al. | D21/205 |
| 4,560,168 | 12/1985 | Aoyama | 473/232 |
| 4,915,390 | 4/1990 | Gobush et al. | 273/232 |
| 4,991,852 | 2/1991 | Pattison | 473/379 |
| 5,018,741 | 5/1991 | Stiefel et al. | 473/379 |

*Primary Examiner*—George J. Marlo
*Attorney, Agent, or Firm*—Pennie & Edmonds LLP

[57] ABSTRACT

A golf ball having an outside surface with a plurality of dimples formed thereon that form at least four spherical-triangular regions. Each of the regions has a first set of dimples formed in a large triangle and a second set of dimples formed in a small triangle inside of and adjacent to the large triangle. The diameters of the first set of dimples vary such that at least one diameter of the first set of dimples is equal to or greater than adjacent dimples nearer to the dimples on the points of the large triangle, and the dimples cover more than 80% of the outer surface with diameters of 0.11 inches or greater. The total number of dimples on the golf ball is about 300 to 500.

20 Claims, 9 Drawing Sheets

GOLF BALL DIMPLE PATTERN

BACKGROUND OF THE INVENTION

The present invention is directed to a golf ball and, more particularly, a golf ball having an improved dimple pattern.

Golf balls were originally made with smooth outer surfaces. In the late nineteenth century, players observed that the guttie golf balls travelled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60% of their outer surface covered by dimples. In 1983, Titleist introduced the TITLEIST 384, which, not surprisingly, had 384 dimples that were arranged in an icosahedral pattern. About 76% of its outer surface was covered with dimples. Today's dimpled golf balls travel nearly two times farther than a similar ball without dimples.

There have also been many patents directed to various dimple patterns. U.S. Pat. No. 4,560,168, which issued to the present inventor, is directed to an icosahedron pattern with six great circles that do not intersect any dimples. The pattern is similar to the present invention in that it has the triangular regions of the icosahedron pattern. However, this type of pattern provided a relatively low surface area coverage, i.e., less than 75% of the outer surface is covered by dimples.

The dimples on a golf ball are important in reducing drag and increasing lift. Drag is the air resistance that acts on the golf ball in the opposite direction from the balls flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance travelled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities.

SUMMARY OF THE INVENTION

The present invention is directed to a golf ball dimple pattern that provides a surprisingly better dimple packing than any previous pattern so that a greater percentage of the surface of the golf ball is covered by dimples. The prior art golf balls have dimple patterns that leave many large spaces between adjacent dimples and/or use small dimples to fill in the spaces. The golf balls according to the present invention have triangular regions with a plurality of dimple sizes arranged to provide a remarkably high percentage of dimple coverage while avoiding groupings of relatively large dimples.

The triangular regions have a first set of dimples formed in a large triangle and a second set of dimples formed in a small triangle inside of and adjacent to the large triangle. The first set of dimples forming the large triangle comprises dimples that increase in size from the dimples on the points of the triangle toward the midpoint of the triangle side. Thus, the dimples close to or on the midpoint of the sides of the triangle are the largest dimples on the large triangle. Each dimple diameter along the triangle side is equal to or greater than the adjacent dimple toward the vertex or triangle point. Through this layout and with proper sizing, as set forth below, the dimple coverage is greater than 80% of the surface of the golf ball.

Further, the dimples are arranged so that there are three or less great circle paths that do not intersect any dimples to minimize undimpled surface area. Great circles take up a significant amount of the surface area and an intersection of more than two great circles creates very small angles that have to be filled with very small dimples or large gaps are created.

Still further, the dimples are arranged such that there are no more than two adjacent dimples of the largest diameter. Thus, the largest dimples are more evenly spaced over the ball and are not clumped together.

The golf balls according to the present invention have dimples that cover more than 80% of the outer surface. More importantly, the dimple coverage is not accomplished by the mere addition of very small dimples that do not effectively contribute to the creation of turbulence. Preferably, the total number of dimples is about 300 to about 500 and at least about 80% of the dimples have a diameter of about 0.11 inches or greater. More preferably, at least about 90% of the dimples have a diameter of about 0.11 inches or greater. Most preferably, at least about 95% of the dimples have a diameter of about 0.11 inches or greater.

The first embodiment of the present invention is a golf ball having an icosahedron dimple pattern. The pattern comprises 20 triangles made from about 362 dimples and does not have a great circle that does not intersect any dimples. Each of the large triangles, preferably, has an odd number of dimples (7) along each side and the small triangles have an even number of dimples (4) along each side. To properly pack the dimples, the large triangle has nine more dimples than the small triangle. In the first embodiment, the ball has five different sizes of dimples in total. The sides of the large triangle have four different sizes of dimples and the small triangles have two different sizes of dimples.

The second embodiment of the present invention is a golf ball also having an icosahedron dimple pattern. The pattern is substantially similar to the first embodiment, but the large triangle is comprised of three different sizes of dimples and the small triangles have only one size of dimple. In the second embodiment, there are 392 dimples and one great circle that does not intersect any dimples.

The third embodiment of the present invention is a golf ball having an octahedron dimple pattern. The pattern comprises eight triangles made from about 440 dimples and has three great circles that do not intersect any dimples.

In the octahedron pattern, the pattern comprises a third set of dimples formed in a smallest triangle inside of and adjacent to the small triangle. To properly pack the dimples, the large triangle has nine more dimples than the small triangle and the small triangle has nine more dimples than the smallest triangle. In this embodiment, the ball has six different dimple sizes distributed over the surface of the ball. The large triangle has five different dimple sizes, the small triangle has three different dimple sizes and the smallest triangle has two different dimple sizes.

DESCRIPTION OF THE PREFERRED EMBODIMENTS

Figure 1:
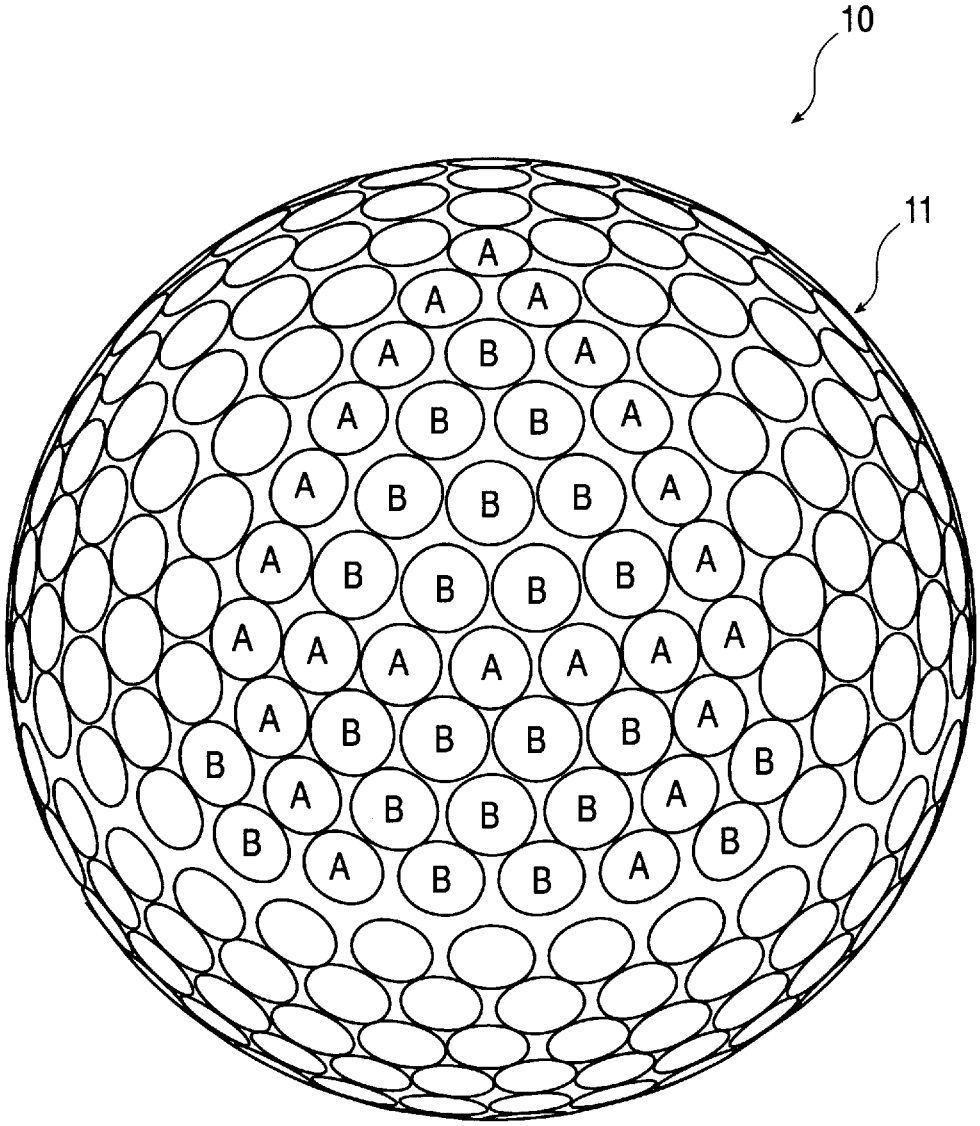
FIG. 1 PRIOR ART
FIG. 1 is an isometric view of the icosahedron pattern used on the prior art TITLEIST PROFESSIONAL ball showing dimple sizes.
Figure 2:
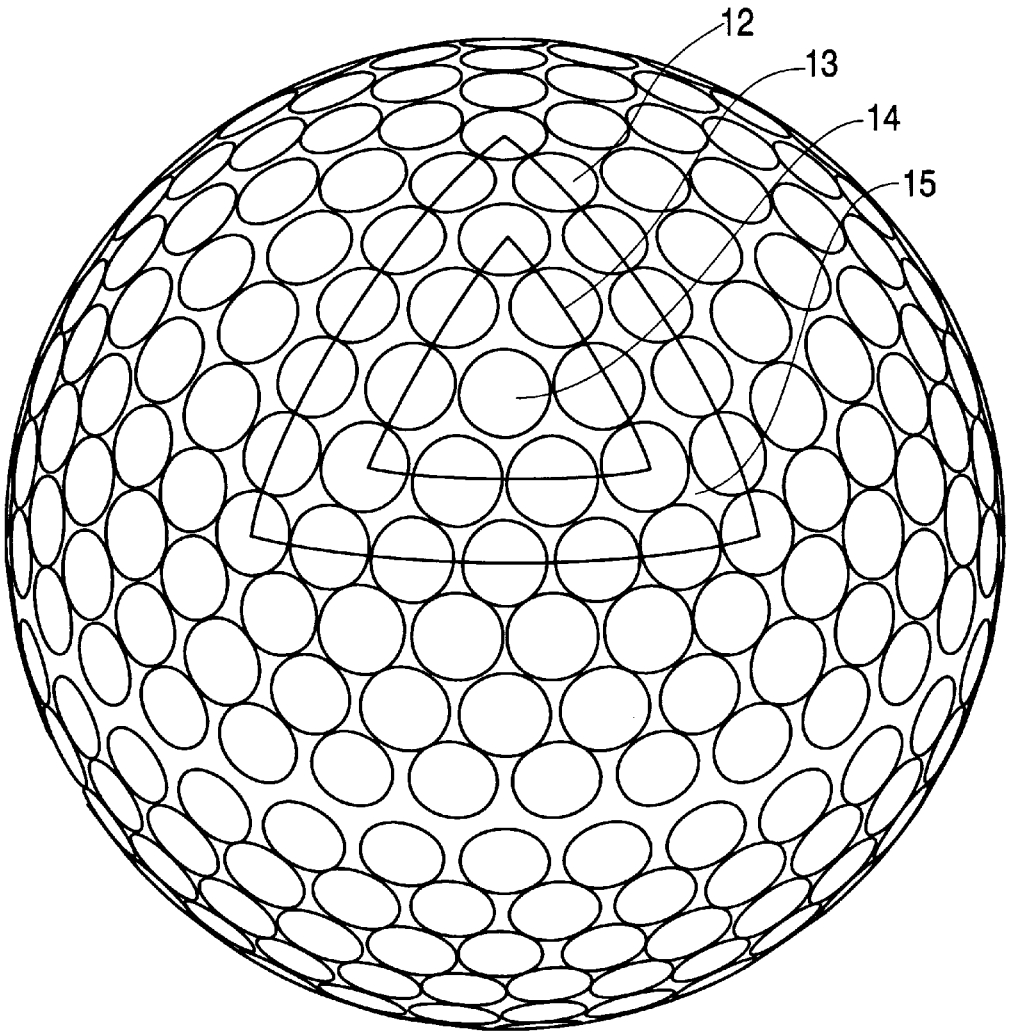
FIG. 2 PRIOR ART
FIG. 2 is an isometric view of the icosahedron pattern used on the prior art TITLEIST PROFESSIONAL ball showing the triangular regions formed by the icosahedron pattern.

Referring to FIGS. 1 and 2, the TITLEIST PROFESSIONAL golf ball 10 has a plurality of dimples 11 on its outer surface that are formed into a dimple pattern having two sizes of dimples. The first set of dimples A have diameters $D_A$ of about 0.14 inches. The first set of dimples A form the outer triangle 12 of the icosahedron dimple pattern. The second set of dimples B have diameters $D_B$ of about 0.16 inches. The second set of dimples B form the inner triangle 13 and the center dimple 14. The dimples 11 cover less than 80% of the outer surface of the golf ball and there are a significant number of large spaces 15 between adjacent dimples, i.e., spaces that could hold a dimple of 0.03 inches diameter or greater.

Figure 3:
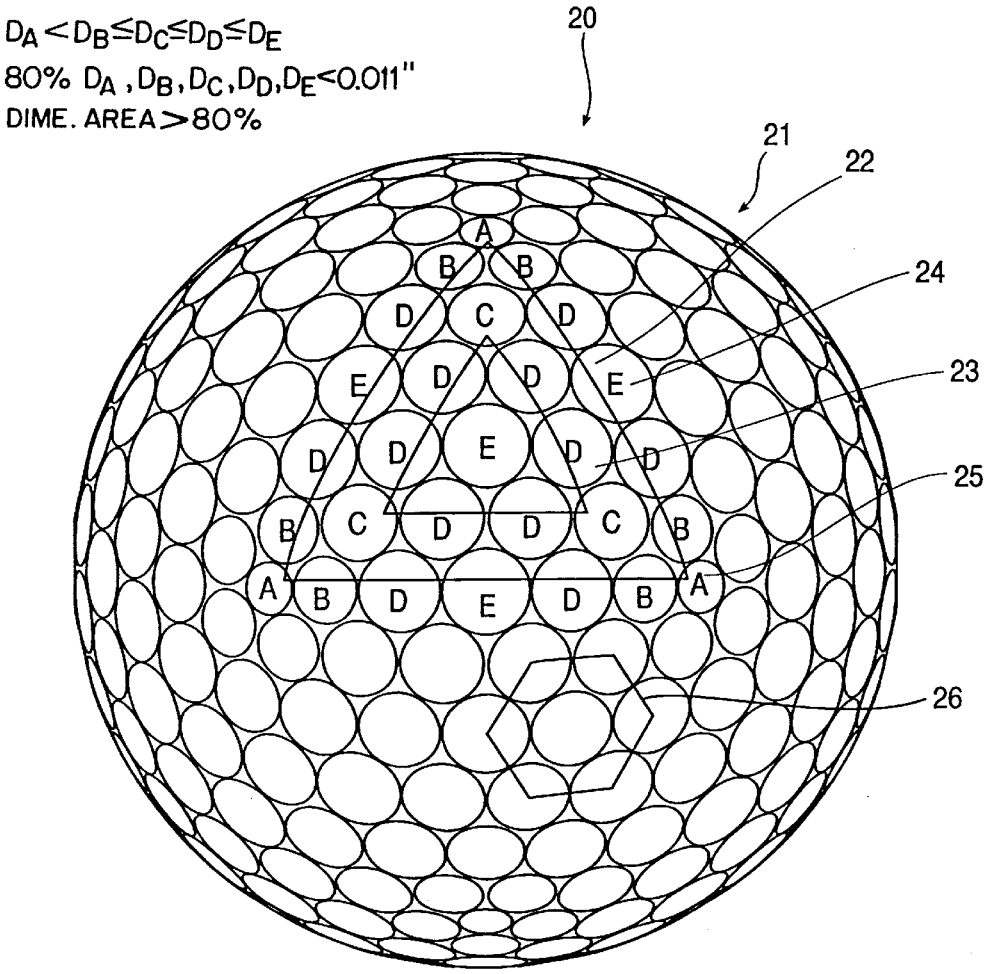
FIG. 3 is an isometric view of a first embodiment of a golf ball according to the present invention having an icosahedron pattern, showing dimple sizes.
Figure 4:
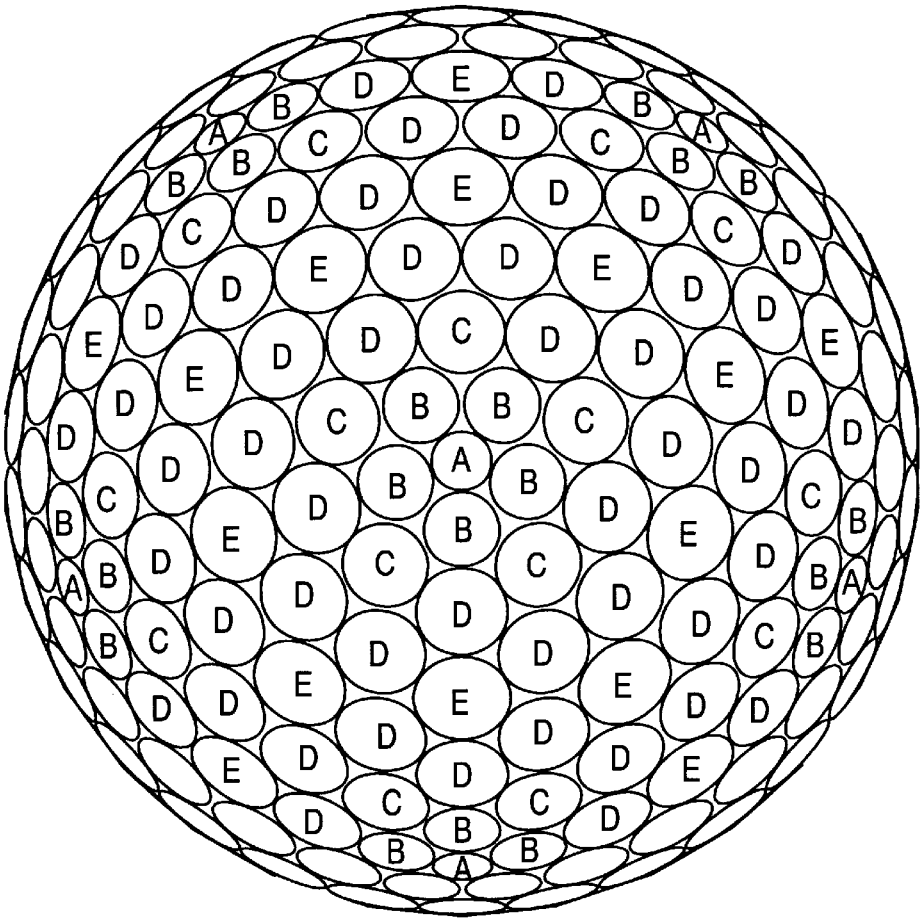
FIG. 4 is a top view of the golf ball in FIG. 3, showing dimple sizes and arrangement.

Referring now to FIGS. 3 and 4, a golf ball 20 according to the present invention has a plurality of dimples 21 in an icosahedron pattern. In an icosahedron pattern, there are 20 triangular regions that are generally formed from the dimples. The icosahedron pattern has 5 triangles formed at both the top and bottom of the ball. Each of the 5 triangles shares the pole dimple as a point. There are also 10 triangles that extend around the middle of the ball. It is possible to manufacture a golf ball without a great circle equator that does not intersect any dimples. However, most balls have one in order to ease manufacturing and in particular buffing of the golf balls after molding. Also, many players prefer to have an equator so that they can use it to line up putts. Thus, icosahedron patterns generally have modified triangles around the mid-section to create the equator that does not intersect any dimples. The modification to the triangles will be discussed in more detail later with reference to the second embodiment.

In this embodiment, there are five different sized dimples A–E having diameters $D_A$, $D_B$, $D_C$, $D_D$ and $D_E$, respectively. Dimples B have a greater diameter than dimples A. Dimples C have a greater diameter than dimples B. Dimples D have a greater diameter than dimples C. Dimples E have a greater diameter than dimples D. The preferred dimple sizes are set forth in Table 1 below:

TABLE 1

| Dimple | Diameter (inches) |
|---|---|
| A | .11 |
| B | .14 |
| C | .16 |
| D | .17 |
| E | .18 |

The dimples are formed in large triangles 22 and small triangles 23. The dimples along the sides of the large triangle 22 increase in diameter toward the midpoint 24 of the sides. The dimple E at the midpoint 24 of the side is the largest dimple along the side and the dimples A at the points 25 of the triangle are the smallest. In this embodiment, each dimple along the sides is larger than the adjacent dimple toward the triangle point.

The golf ball 20 has a greater dispersion of the largest dimples. In FIG. 3, there are four E dimples, the largest diameter, located in the center of the triangles and at the mid-points of the triangle sides. Thus, there are no two adjacent dimples of the largest diameter. This improves dimple packing and aerodynamic uniformity.

Still further, each of the sides of the large triangle 22 has an odd number of dimples and each of the sides of the small triangle 23 has an even number of dimples. The large triangle 22 has nine more dimples than the small triangle 23. This creates hexagonal packing 26, i.e., each dimple is surrounded by six other dimples for most of the dimples on the ball. For example, the center E dimple is surrounded by six D dimples. Preferably at least 75% of the dimples have 6 adjacent dimples. More preferably, only the dimples A forming the points of the large triangle 25 do not have hexagonal packing. However, since the dimples A are smaller than the adjacent dimples, the spacing between adjacent dimples is surprisingly small when compared to the prior art golf ball shown in FIG. 1.

For purposes of this application, adjacent dimples can be considered as any two dimples where the two tangent lines from the first dimple that intersect the center of the second dimple do not intersect any other dimple. Preferably, in the golf balls according to the present invention, less than 30% of the spacings between adjacent dimples is greater than 0.01 inches. More preferably, less than 15% of the spacings between adjacent dimples is greater than 0.01 inches. Thus, the percentage of surface area covered by dimples in the embodiment shown in FIGS. 3 and 4 is about 85.7%, whereas the ball shown in FIG. 1 has less than 80% of its surface covered by dimples. This is very surprising considering that the prior art golf ball was designed for maximum coverage, and even has some dimples which overlap slightly because they are positioned so closely together.

In the golf ball shown in FIG. 3, there is no great circle path that does not intersect any dimples. This increases the percentage of the outer surface that is covered by dimples, but makes manufacturing more difficult. The golf balls according to the present invention should have the dimples arranged so that there are less than four great circle paths that do not intersect any dimples. In the icosahedron embodiments, there is preferably no great circle path or only one great circle path at the equator that does not intersect any dimples.

In the golf ball shown in FIGS. 3 and 4, there are 362 dimples. Preferably, the golf balls according to the present invention have about 300 to about 500 dimples in total. More preferably, in the icosahedron type patterns, the golf balls have about 350 to about 450 dimples. Furthermore, the golf balls according to the present invention have a dimple coverage of greater than about 80%. Still further, it is preferred that at least about 80% of the dimples have a diameter of about 0.11 inches or greater so that the majority of the dimples are sufficiently large to assist in creating the turbulent boundary layer. More preferably, the dimples are sized such that at least about 90% of the dimples have a diameter of about 0.11 inches or greater. Most preferably, at least about 95% of the dimples have a diameter of about 0.11 inches or greater.

Still further, each of the sides of the large triangles is formed from an odd number of dimples. In the icosahedron pattern shown in FIGS. 3 and 4, there are 7 dimples along each of the sides of the large triangle. Moreover, each side of the small triangle is comprised of sides formed from an even number of dimples. In the icosahedron pattern shown in FIGS. 3 and 4, there are 4 dimples along each of the sides of the small triangle.

Referring now to FIGS. 5–8, another golf ball 20 according to the present invention has a plurality of dimples 21 in an icosahedron pattern. In this embodiment, there are again five different sized dimples A–E having diameters $D_A$, $D_B$, $D_C$, $D_D$, and $D_E$, respectively. Dimples B have a greater diameter than dimples A. Dimples C have a greater diameter than dimples B. Dimples D have a greater diameter than dimples C. Dimples E have a greater diameter than dimples D. The preferred dimple sizes are set forth in Table 2 below:

TABLE 2

| Dimple | Diameter (inches) |
|---|---|
| A | .11 |
| B | .15 |
| C | .155 |
| D | .16 |
| E | .17 |

Figure 7:
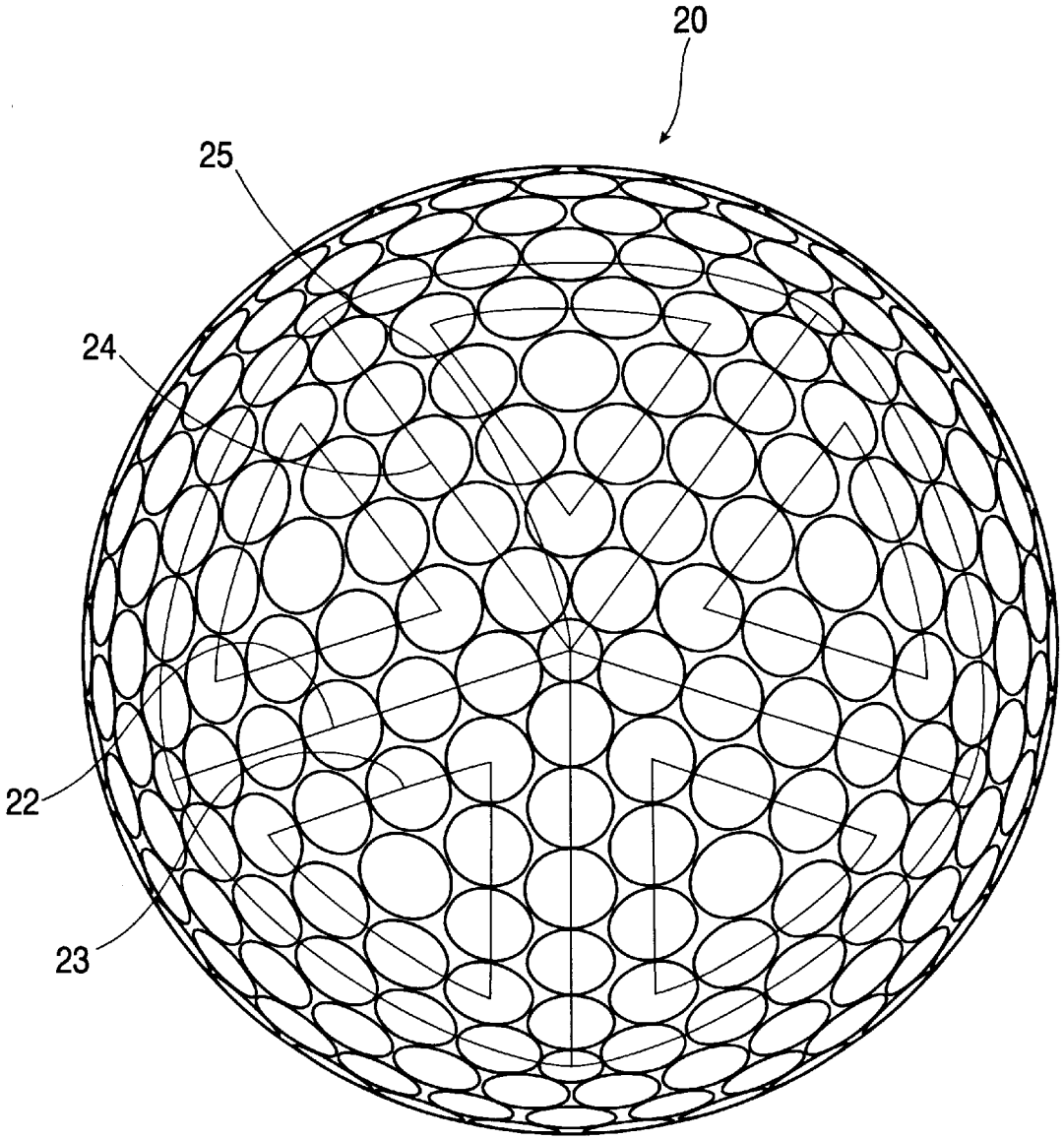
FIG. 7 is a top view of the golf ball in FIG. 5, showing dimple arrangement.

In the second embodiment of the present invention shown in FIGS. 5–8, the dimples are again formed in large triangles 22 and small triangles 23 as shown in FIG. 7. The dimples along the sides of the large triangle 22 increase in diameter toward the midpoint 24 of the sides. The dimple D at the midpoint 24 of the side is the largest dimple along the side and the dimples A at the points 25 of the triangle are the smallest. In this embodiment, each dimple along the sides is equal to or larger than the adjacent dimple. That is, dimple B is larger than dimple A and dimple D is larger than dimple B.

Like in the first embodiment, each of the sides of the large triangle 22 has a odd number of dimples and each of the sides of the small triangle 23 has an even number of dimples. The large triangle 22 has nine more dimples that the small triangle 23. This creates the hexagonal packing. Again, the only dimples that do not have hexagonal packing are the points of the triangles, or the A dimples. The percentage of surface area covered by dimples in the second embodiment shown in FIGS. 5–8 is about 82%, whereas the ball shown in FIG. 1 has less than 80% of its surface covered by dimples.

In the golf ball shown in FIGS. 5–8, there is one great circle path 27 that does not intersect any dimples. This decreases the percentage of the outer surface that is covered by dimples from the first embodiment, but eases manufacturing.

In the golf ball shown in FIGS. 5–8, there are 392 dimples. All of the dimples have a diameter of about 0.11 inches or greater.

Figure 8:
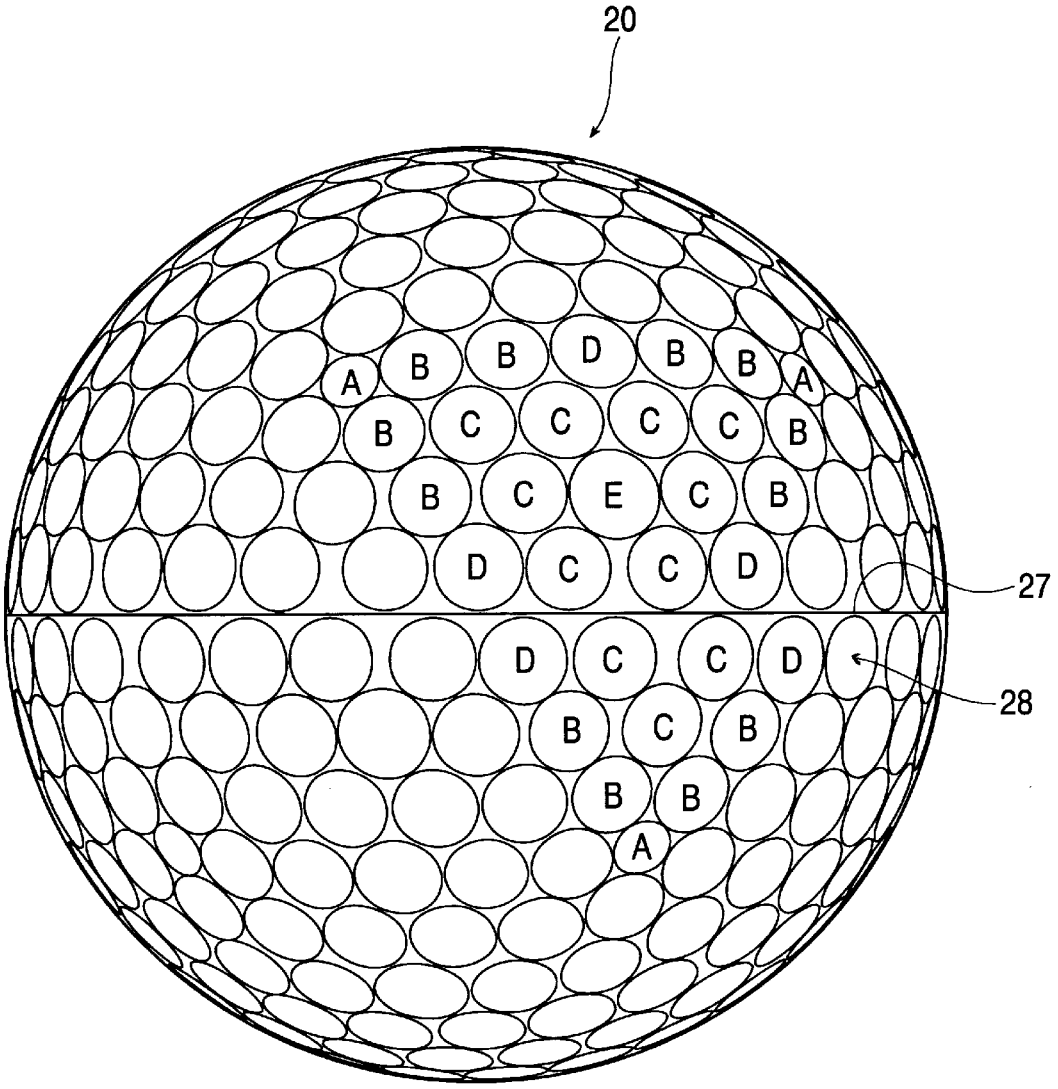
FIG. 8 is a side view of the golf ball in FIG. 5, showing the dimple arrangement at the equator.

Referring specifically to FIG. 8, the golf ball in this embodiment has a modified icosahedron pattern to create the great circle path 27 at the equator. The pattern is modified by inserting an extra row of dimples. In the triangular section identified with lettered dimples, there is an extra row 28 of D-C-C-D dimples added below the great circle path 27. Thus, the modified icosahedron pattern in the second embodiment has 30 more dimples than the unmodified icosahedron pattern in the first embodiment.

Figure 5:
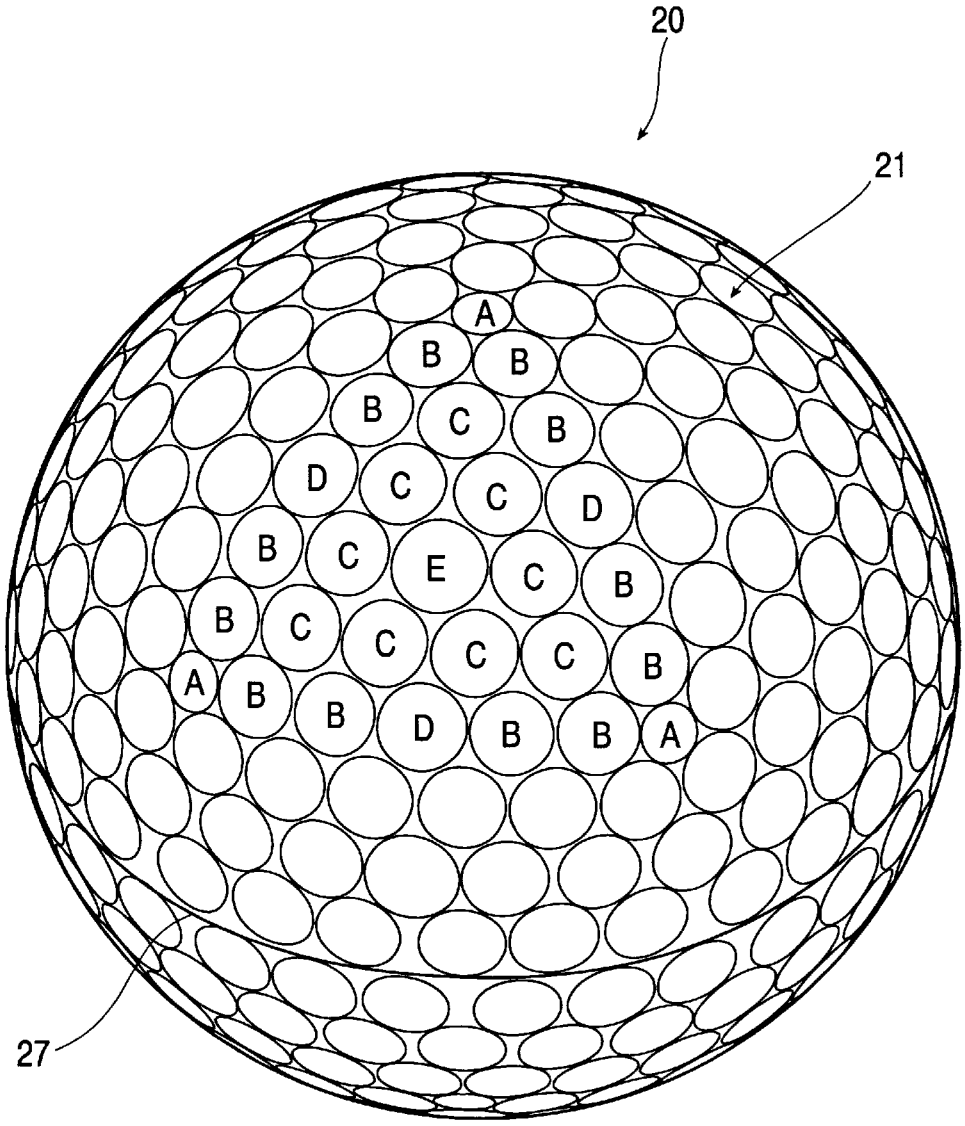
FIG. 5 is an isometric view of a second embodiment of a golf ball according to the present invention having an icosahedron pattern, showing dimple sizes and the triangular regions formed from the icosahedron pattern.
Figure 6:
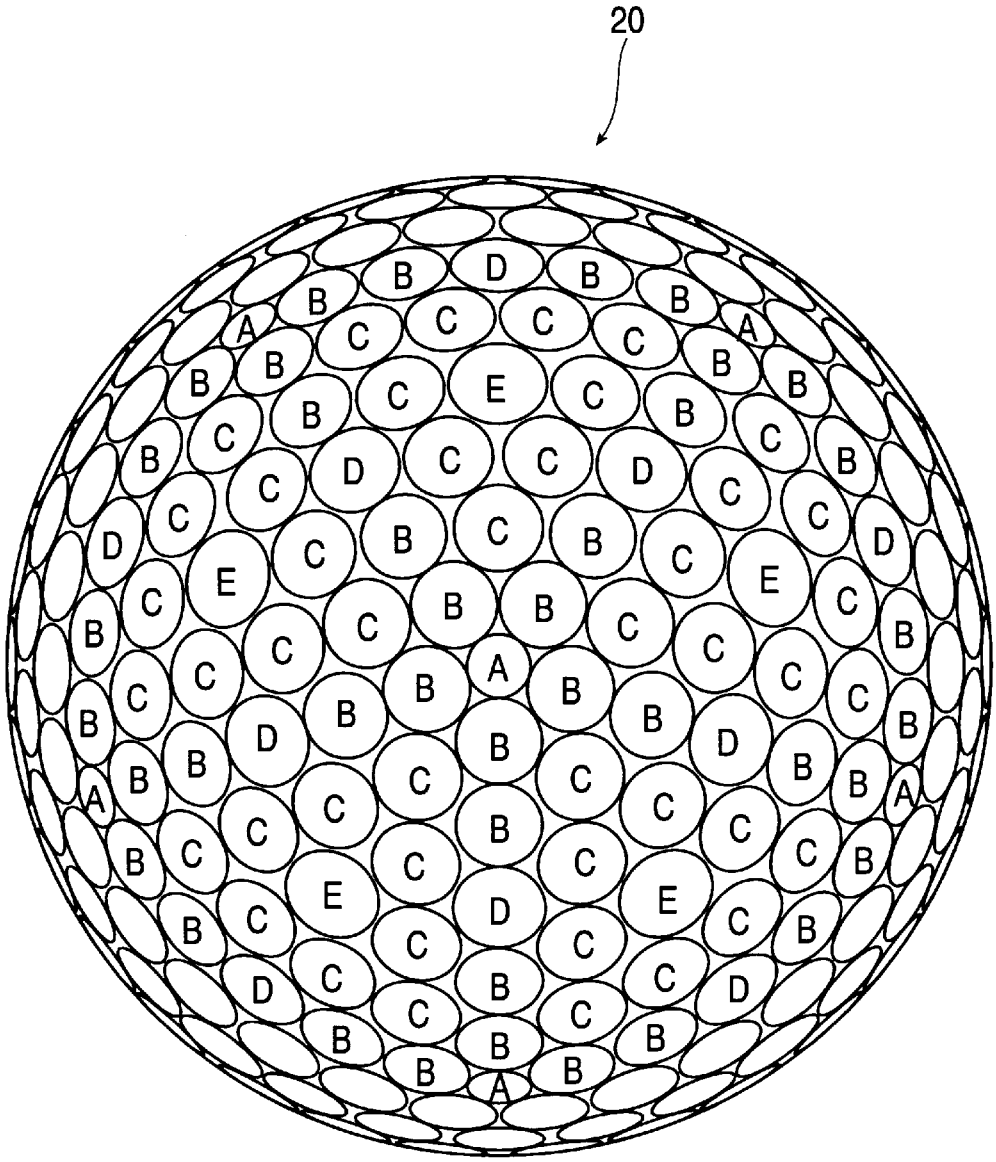
FIG. 6 is a top view of the golf ball in FIG. 5, showing dimple sizes and arrangement.

Still further, the golf ball 20 has a greater dispersion of the largest dimples. In FIG. 5, there is only 1 E dimple, the largest diameter, located in the center of the triangles. Thus, there are no two adjacent dimples of the largest diameter. Even the next to the largest dimples D are dispersed at the mid-points of the large triangles such that there are no two adjacent dimples of the two largest diameters, except where extra dimples have been added along the equator. This improves dimple packing and aerodynamic uniformity.

Figure 9:
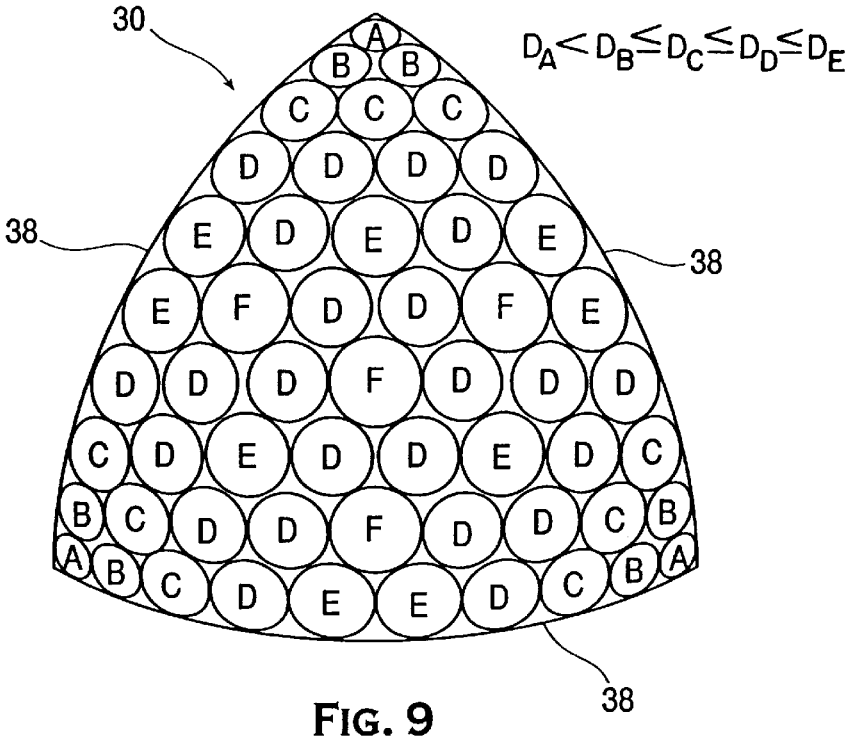
FIG. 9 is a spherical-triangular region of a golf ball according to the present invention having an octahedral dimple pattern, showing dimple sizes.
Figure 10:
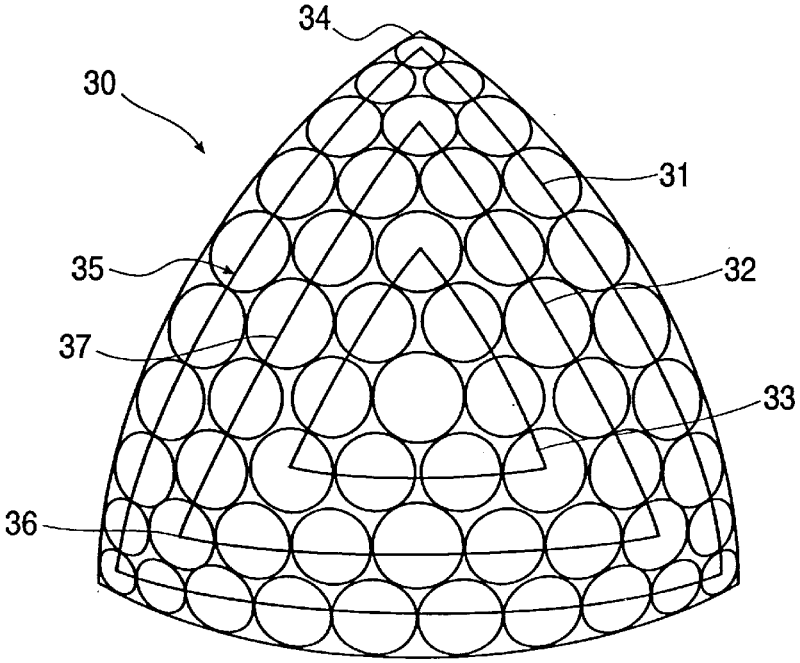
FIG. 10 is the spherical triangular region of FIG. 9, showing the triangular dimple arrangement.

Referring to FIGS. 9 and 10, a golf ball according to the present invention can have an octahedral dimple pattern. In an octahedral dimple pattern, there are 8 spherical triangular regions 30 that form the ball. In this embodiment, there are six different sized dimples A–F having diameters $D_A$, $D_B$, $D_C$, $D_D$, $D_E$, and $D_F$, respectively. Dimples B have a greater diameter than dimples A. Dimples C have a greater diameter than dimples B. Dimples D have a greater diameter than dimples C. Dimples E have a greater diameter than dimples D. Dimples F have a greater diameter than dimples E. The preferred dimple sizes are set forth in Table 3 below:

TABLE 3

| Dimple | Diameter (inches) |
|---|---|
| A | .09 |
| B | .11 |
| C | .14 |

TABLE 3-continued

| Dimple | Diameter (inches) |
|---|---|
| D | .15 |
| E | .16 |
| F | .17 |

In the third embodiment of the present invention shown in FIGS. 9 and 10, the dimples are formed in large triangles 31, small triangles 32 and smallest triangles 33. In this embodiment, each dimple along the sides of the large triangle 31 is equal to or larger than the adjacent dimple from the point 34 to the midpoint 35 of the triangle 31. The dimples E at the midpoint 35 of the side are the largest dimples along the side and the dimples A at the points 34 of the triangle are the smallest. Still further in this embodiment, each dimple along the sides of the small triangle 32 is also equal to or larger than the adjacent dimple from the point 36 to the midpoint 37 of the triangle 32. The dimple F at the midpoint 37 of the side is the largest dimple along the side and the dimples C at the points 36 of the triangle are the smallest.

In this embodiment, each of the sides of the large triangle 31 has an even number of dimples, each of the sides of the small triangle 32 has an odd number of dimples and each of the sides of the smallest triangle 33 has an even number of dimples. The large triangle 31 has nine more dimples than the small triangle 32 and the small triangle 32 has nine more dimples than the smallest triangle 33. This creates the hexagonal packing for all of the dimples inside of the large triangles 31. The percentage of surface area covered by dimples in the third embodiment shown in FIGS. 9 and 10 is about 82%, whereas the prior art octahedral balls have less than 77% of their surface covered by dimples, and most have less than 60%. Thus, there is a significant increase in surface area.

In the octahedral golf ball shown in FIGS. 9 and 10, there are three great circle paths 38 that do not intersect any dimples. This decreases the percentage of the outer surface that is covered by dimples from the first embodiment, but eases manufacturing.

In the golf ball shown in FIGS. 9 and 10, there are 440 dimples. Preferably, in the octahedral type patterns, the golf balls have about 300 to about 500 dimples. Again, it is preferred that at least about 80% of the dimples have a diameter of about 0.11 inches or greater and, more preferably, that at least about 90% of the dimples have a diameter of about 0.11 inches or greater.

In this embodiment, The sides of the large triangle have an even number of dimples, the sides of the small triangles have an odd number of dimples and the sides of the smallest triangles have an even number of dimples. There are 10 dimples along the sides of the large triangles, 7 dimples along the sides of the small triangles and 4 dimples along the sides of the smallest triangles.

While it is apparent that the illustrative embodiments of the invention herein disclosed fulfill the objectives stated above, it will be appreciated that numerous modifications and other embodiments such as tetrahedrons having four triangles may be devised by those skilled in the art. Therefore, it will be understood that the appended claims are intended to cover all such modifications and embodiments which come within the spirit and scope of the present invention.

What is claimed is:

1. In a golf ball having an outside surface with a plurality of dimples formed thereon, the dimples being round and forming a plurality of spherical-triangular regions;

wherein each region has a first set of dimples formed in a large triangle having three sides and three points and a second set of dimples formed in a small triangle inside of and adjacent to the large triangle;

wherein the first set of dimples forming the large triangle comprises first dimples forming the three points having first diameters and at least five second dimples along each of the sides having second diameters larger than the first diameters and the diameters of each of the second dimples of the first set are equal to or greater than adjacent dimples which are nearer the first dimples on the points of the large triangle; and the dimples cover more than 80% of said outside surface.

2. The golf ball of claim 1, said dimples being arranged so that there are less than four great circle paths that do not intersect any dimples.

3. The golf ball of claim 2, wherein the total number of dimples is 350 to 450.

4. The golf ball of claim 3, wherein at least 80% of the dimples have a diameter of 0.11 inches or greater.

5. The golf ball of claim 4, wherein at least 95% of the dimples have a diameter of 0.11 inches or greater.

6. The golf ball of claim 1, wherein each side of the large triangle is formed from an odd number of dimples.

7. The golf ball of claim 6, wherein each side of the large triangle further comprises a third sized dimple located at a midpoint of the sides and having a third diameter larger than the second diameter.

8. The golf ball of claim 7, wherein the small triangle is comprised of sides formed from an even number of dimples.

9. The golf ball of claim 8, wherein the large triangle has nine more dimples than the small triangle.

10. The golf ball of claim 9, further comprising a center dimple located inside the small triangle and having a diameter greater than or equal to the third sized dimple diameter.

11. The golf ball of claim 10, wherein the surface of the golf ball is comprised of twenty spherical-triangular triangular regions.

12. The golf ball of claim 11, wherein the golf ball has a icosahedron dimple pattern.

13. The golf ball of claim 1, wherein the sides of the large triangle comprise at least three different diametered dimples, the dimple diameters being equal to or greater than the diameter of the adjacent dimple on the side closer to the triangle point.

14. The golf ball of claim 1, further comprising a third set of dimples formed in a smallest triangle inside of and adjacent to the small triangle, wherein the large triangle has nine more dimples than the small triangle and the small triangle has nine more dimples than the smallest triangle.

15. The golf ball of claim 14, wherein each side of the small triangle is comprised of third sized dimples forming the three points of the small triangle having a third diameter and fourth sized dimples along the sides of the small triangle having a fourth diameter larger than the third diameter and a fifth sized dimple located at a midpoint of the sides of the small triangle and having a fifth diameter larger than the fourth diameter.

16. The golf ball of claim 15, wherein the smallest triangle is comprised of sides formed from an even number of dimples.

17. In a golf ball having an outside surface with a plurality of dimples formed thereon, the dimples being round and forming a plurality of spherical-triangular regions;

wherein each region has a first set of dimples formed in a large triangle having three sides and three points and a second set of dimples formed in a small triangle inside of and adjacent to the large triangle;

wherein the first set of dimples forming the large triangle comprises first dimples forming the three points having first diameters and at least five second dimples along each of the sides having second diameters larger than the first diameters and the diameters of the second dimples of each of the first set are equal to or greater than adjacent second dimples which are nearer the first dimples on the points of the large triangle;

said dimples being arranged such that there are no adjacent dimples of a largest diameter.

18. The golf ball of claim 17, wherein the dimples cover more than 80% of the outer surface.

19. The golf ball of claim 17, said dimples being arranged so that there are no adjacent dimples of a second to largest diameter.

20. The golf ball of claim 17, wherein at least 80% of the dimples have a diameter of 0.11 inches or greater.

* * * * *